US006923315B2

(12) United States Patent
Lo Duca

(10) Patent No.: US 6,923,315 B2
(45) Date of Patent: Aug. 2, 2005

(54) BOX WITH FOLDING PANEL FOR EXTRACTING AN ILLUSTRATIVE LEAFTLET

(75) Inventor: Carmelo Lo Duca, Milan (IT)

(73) Assignee: GI.BI.EFFE SRL, Milan (IT)

( * ) Notice: Subject to any disclaimer, the term of this patent is extended or adjusted under 35 U.S.C. 154(b) by 224 days.

(21) Appl. No.: 10/385,455

(22) Filed: Mar. 12, 2003

(65) Prior Publication Data

US 2003/0173238 A1 Sep. 18, 2003

(30) Foreign Application Priority Data

Mar. 15, 2002 (IT) ..... MI2002A0560

(51) Int. Cl.[7] ..... B65D 69/00
(52) U.S. Cl. ..... 206/232
(58) Field of Search ..... 206/232, 271, 206/273, 297, 299, 362.4, 525.1, 784, 45.21, 45.23, 45.29

(56) References Cited

U.S. PATENT DOCUMENTS 3,099,381 A 7/1963 Meyers
3,147,856 A 9/1964 Lightner et al.
4,696,397 A * 9/1987 Nakamats ..... 206/308.3
RE33,503 E * 12/1990 Schluger ..... 206/45.29
4,989,728 A * 2/1991 Neyret et al. ..... 206/91
5,078,268 A 1/1992 Olson et al.
5,203,495 A * 4/1993 Jorgensen-Beck et al. .. 229/225
5,513,752 A * 5/1996 Gottlieb ..... 206/387.1
6,032,795 A * 3/2000 Ehrlund et al. ..... 206/312
6,070,719 A * 6/2000 Pollock ..... 206/232
6,505,739 B2 * 1/2003 Garnier ..... 206/312
6,742,651 B1 * 6/2004 Focke et al. ..... 206/268

FOREIGN PATENT DOCUMENTS

| | | |
|---|---|---|
| DE | 32 08 777 | 9/1983 |
| DE | 86 18 368 | 8/1986 |
| DE | 89 13 001 | 12/1989 |
| DE | 299 01 874 | 4/1999 |
| EP | 0 911 266 | 4/1999 |
| EP | 1 219 542 | 7/2002 |
| GB | 2 277 077 | 10/1994 |
| WO | WO 00/20289 | 4/2000 |

* cited by examiner

*Primary Examiner*—Kurt Fernstrom
(74) *Attorney, Agent, or Firm*—Oblon, Spivak, McClelland, Maier & Neustadt, P.C.

(57) ABSTRACT

A box formed from a single piece of cardboard and having a closure panel which can be folded up about a folding line provided on a side wall of the box in proximity to the free edge of a pocket housing an illustrative leaflet, to enable the leaflet to be gripped and easily extracted from the box.

14 Claims, 2 Drawing Sheets

BOX WITH FOLDING PANEL FOR EXTRACTING AN ILLUSTRATIVE LEAFTLET

FIELD OF THE INVENTION

The present invention relates to a box formed from a single piece of cardboard and defining in its interior a pocket into which, during the manufacture of the box, a leaflet is inserted illustrating a product which is later to be inserted therein by the firm which finishes and uses the box. The term "illustrative leaflet" means any sheet, possibly folded several times on itself, carrying writing and instructions relative to the product contained in the box, or a card extractable from the pocket and having images or writing of any type reproduced on it.

BACKGROUND OF THE INVENTION

Very often, illustrative leaflets or the like are also inserted into boxes in which products of various kinds are housed, preserved and transported. A frequent case is that in which the products inserted into the boxes are containers, bottles, or flat packs defining a plurality of recesses containing pharmaceutical products in the form of capsules or tablets: in that case, a leaflet illustrating the pharmaceutical product must compulsorily be present in the actual boxes into which the bottle, container or the like is inserted.

In the usual known art, the boxes are produced by specialist firms, whereas the bottles or the like together with the relative illustrative leaflets are inserted later by the finishing firm: this operation is relatively laborious and slow, especially as a result of the difficulties encountered in inserting the leaflets (often of large dimensions and folded over several times) into the box in such a manner that it still allows the bottle or packs to be freely inserted without the leaflet becoming creased.

To obviate these problems boxes have been proposed formed from a single piece of cardboard and defining in their interior a pocket into which the illustrative leaflet is inserted directly by the manufacturer of the box, the user of which (i.e. the finishing firm) has then merely to insert the articles (bottles or others) which the box is to contain.

Obviously, the leaflet must be retained securely inside each box so that it does not interfere with the article inserted into the box by the finishing firm. Moreover, the boxes must be of such a structure that the illustrative leaflets can be easily withdrawn from and then returned to the boxes by the box user.

DISCUSSION OF THE RELATED ART

GB-A-2277077 (see FIGS. 3 and 4) and DE-A-3208777 (see FIG. 2) describe boxes, into the interior of which there projects a freely rotatable flap which on one of its sides is rigid with one of the main side walls of the box, this flap facing a different main wall of the same box to form therewith a pocket housing the illustrative leaflet.

U.S. Pat. No. 3,147,856 (FIG. 3) and EP-A-0911266 (FIG. 2) describe boxes similar to those of the two aforementioned patents, but in which the flaps defining the pocket in the box interior have their its free end folded at 90° about itself to form a tab which is glued to the adjacent main side wall of the box.

An improved type of box with an inner pocket for an illustrative leaflet is described in Italian patent application M12001A002214 filed on Oct. 23, 2001 corresponding to the U.S. patent application Ser. No. 10/263,847 filed on Apr. 10, 2002 in the name of the present applicants. In it, the flap which defines the pocket within the box is retained in position by a supplementary panel which is folded into the interior of the box and projects from one of the end edges of one of the main side walls of the box.

A requirement common to all boxes of the aforesaid known type is to enable the final box user to easily withdraw the illustrative leaflet from and reinsert it into the box such that the leaflet can remain enclosed and protected within the box when its closure panel is closed.

To satisfy this requirement, WO 0020289 describes a box with an external pocket housing an illustrative leaflet which can be withdrawn from and reinserted into the pocket without having to open the box closure panels; this box has a necessarily greater volume than that required to protect the product which the box is intended to contain and protect, and moreover the leaflet can fall out of the pocket (and hence be lost) or can be withdrawn while the box is still closed and sealed.

GB-A-2277077 describes a box with an internal pocket housing the illustrative leaflet which can be withdrawn by removing a portion of a side wall of the box, in order to free an aperture positioned in correspondence with one of the ends of the leaflet, which can hence be withdrawn from the box even without opening its end panels; such a construction, after the removal of the said portion of its side wall, weakens the mechanical strength of the box, leaves the leaflet always visible, and makes reinsertion of the leaflet into the pocket very difficult, especially if the leaflet is of large dimensions and is folded several times on itself. Finally, as a portion of at least one side wall of the box has to be removed to withdraw the leaflet, its obvious that writing relative to the product contained in the box cannot be printed on that portion, this representing a serious drawback because boxes of this type are of relatively small dimensions, their entire surface being used to print writing of various kinds.

EP-A-0911266, U.S. Pat. No. 3,099,381 and U.S. Pat. No. 3,147,856 describe boxes housing in their interior illustrative leaflets which can be withdrawn by tearing off a substantial part of a side wall, to hence completely free the leaflet which can be easily withdrawn but cannot then be rehoused, retained and preserved within the pocket which is no longer reclosable. There is also the aforesaid problem, i.e. that an entire side wall of the box cannot be used in practice for carrying writing which must always be readable by the box user, even after the leaflet has been withdrawn.

SUMMARY OF THE INVENTION

The main object of the present invention is therefore to provide a box of simple and economical structure with an internal pocket into which an illustrative leaflet can be inserted directly by the box manufacturer, with the leaflet preserved and protected in the box interior when its closure panels are closed, the box being such that the leaflet can be withdrawn from its pocket and then be easily reinserted into it when the closure panel is in its raised open position, the entire outer surface of the box being also usable for applying writing visible at all times and under all conditions. These and further objects are attained by a box formed from a single piece of punched and crease-lined cardboard or the like, defining an internal pocket for containing an extractable leaflet, comprising:

at least four consecutive main panels and a flap which projects from the first main panel and is superposed on and glued to the last main panel in the finished box;

an end panel which projects from the last main panel and has a width equal to or less than that of the first main panel, to which it faces in the box interior to form with said first panel a pocket for containing said leaflet;

parallel longitudinal folding lines separating the main panels, the end panel and said flap from each other;

for at least one end of the box, a closure panel projecting from one end of the first main panel and separated from it by a first transverse folding line about which the closure panel can be rotated to open and respectively close said end of the box;

the main panels and also the end panel being folded about their longitudinal folding lines in such a manner that the end panel becomes superposed on the first main panel in the interior of the box to form said pocket therewith;

wherein in said first main panel there are provided both a second transverse folding line and a pair of cuts or tearable knurlings which extend between the ends of the first transverse folding line and the second transverse folding line to enable the closure panel to be rotated outwards and with it that portion of the first main panel which is bounded by the two transverse folding lines and by said pair of cuts or knurlings, hence leaving uncovered and accessible from the outside of the box at least a portion of the leaflet housed in the internal pocket of the box.

Preferably, at least a part of that free edge of the end panel facing said closure panel is more distant from the first transverse folding line han said second transverse folding line; and said cuts or knurlings are provided in correspondence with those longitudinal folding lines which separate the first main panel from the flap and from the main panel adjacent to it.

Moreover, advantageously that free end of the end panel facing the closure panel is profiled, presenting a recess which intersects said transverse second folding line.

Obviously, the invention also relates to sheets in the form of a single piece of punched and crease-lined cardboard or the like, usable for forming boxes of the aforedefined type.

BRIEF DESCRIPTION O THE DRAWINGS

The structure and characteristics of the box will be more apparent from the ensuing description of one embodiment thereof given by way of non-limiting example with reference to the accompanying drawings, in which.

DETAILED DESCRIPTION OF THE INVENTION

Figure 1:
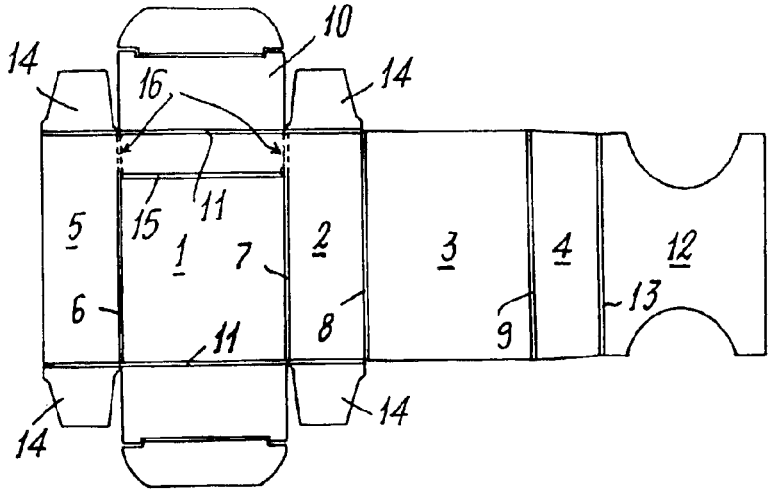
FIG. 1 is a plan view of a spread-out punched and crease-lined piece of cardboard usable for forming a box, the figure showing that surface of the cardboard which is to remain on the inside of the box.

Reference will firstly be made to FIG. 1, which shows a spread-out piece of punched, crease-lined and knurled cardboard seen from its inner side, i.e. the opposite side to that on which the descriptive matter which has to be visible on the outside of the finished box is printed.

The cardboard piece comprises four consecutive main panels 1–4 and a flap 5 projecting from the first of the main panels, i.e. from the panel 1; the said panels and flap are separated one from another by longitudinal parallel folding lines 6–9. From the two opposite ends of the main panel 1 there project two closure panels (separated from the main panel 1 by transverse folding lines 11 perpendicular to the folding lines 6–9) intended to form the lid and respectively the base of the box, whereas from the opposing sides of the flap 5 and main panel 2 there project also closure tabs 14. The upper closure panel, to which reference will be made hereinafter, is indicated by the reference numeral 10. The other closure panel (the lower) of the box can be equal to or different from the upper closure panel 10.

From the last of the main panels, i.e. from the panel 4, there projects a supplementary panel 12 separated from said panel 4 by a longitudinal folding line 13 parallel to the lines 6–9. The total width of the supplementary panel 12 is substantially equal to or slightly less than the width of the two main panels 1 and 3.

It is preferable that at least the upper (with respect to the drawings) free edge of the supplementary panel 12 be profiled, i.e. defined by an arched line or recess to facilitate insertion into the finished box of the product which it is intended to contain, and also facilitate extraction of the illustrative leaflet described hereinafter.

The structure of the punched and crease-lined cardboard sheet described up to this point is known and is illustrated in the prior patents cited in the introduction to this description: while preserving the same functional characteristics, the cardboard sheet can also be as illustrated in the already cited Italian patent application M12001A002214 of Oct. 23, 2001 and in the corresponding U.S. application Ser. No. 10/263,847 in the name of the present applicants.

Figure 2:
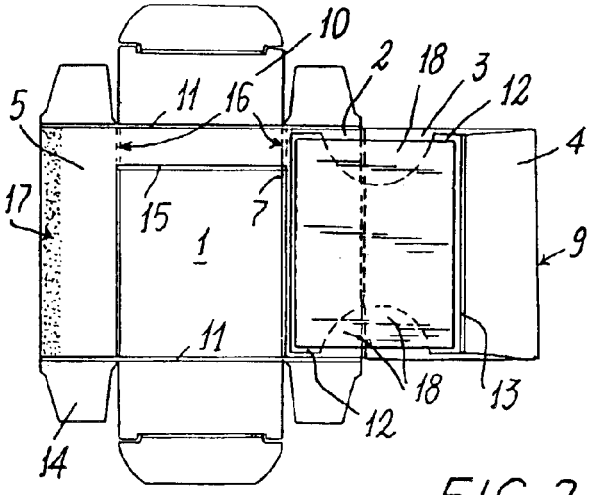
FIGS. 2 and 3 show the piece of cardboard of FIG. 1 in its successive folding steps to form the box.

It will now be assumed that the cardboard processing firm which has produced the punched and crease-lined cardboard sheet of FIG. 1 then folds it in order to form from it the box to be despatched to the box user. In a first step, the main panel 4 together with the end panel 12 are folded about the folding line 9 onto the main panels 2 and 3 (FIG. 2), after which an illustrative leaflet 18—previously printed and possibly folded on itself—is (always automatically) rested on the upper surface of the end panel 12 and one or more lines of glue 17 are applied to the panel 5 (again as shown in FIG. 2), and finally the main panel 1 (and with it the flap 5) is folded about the folding line 7 so that the panel 1 lies superposed on the leaflet 18 and on the underlying end panel 12, whereas the flap 5 lies superposed on the main panel 4 onto which it is fixed by the line of glue 17 (FIG. 3).

Under these conditions the leaflet 18 is housed and retained in a pocket defined by the end panel 12 and the main panel 1.

All the aforedescribed operations can be effected easily at high speed by those cardboard processing firms who produce traditional boxes, employing those automatic machines commonly used by said firms.

Figure 3:
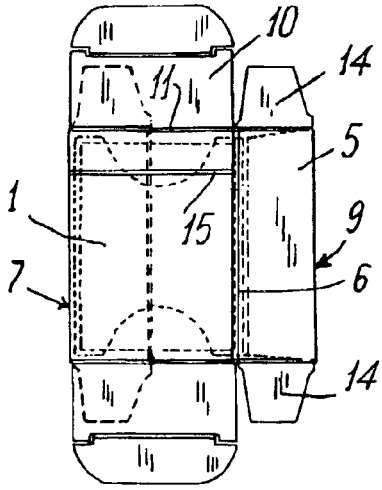

The user firm which receives the box already glued and folded as shown in FIG. 3 then uses its automatic machines of normal use to shape the box by firstly exerting compression on the two opposing corners (i.e. in correspondence with the longitudinal folding lines 7 and 9). The longitudinal free edge of the end panel 12 becomes positioned in correspondence with the folding line 7 (causing the cardboard sheet to fold about the folding lines 6 and 13, which are mutually superposed) and the box assumes the shape shown in perspective view in FIG. 4 in which the lower panel is closed, whereas the upper panel 10 and the flaps 14 are open.

Under these conditions the user firm can easily insert into the box the article which it is intended to house. For example, if the user firm produces pharmaceutical specialities, the article which it inserts into the box can consist of one or more packs (not shown in the drawings) of pharmaceutical tablets or capsules.

A fundamental characteristic of the box (and of the cardboard sheet used for its formation) is that in the first main panel 1 (i.e. that panel from the upper end of which there extends the upper closure panel 10 of the box) there is provided a second transverse folding line 15 about which the panel 10 can be rotated to open or close the box. Another fundamental characteristic is that between the two transverse folding lines 11, 15 there are provided cuts or knurled lines 16 (which define predetermined facilitated tearing lines) which extend from the one to the other folding line 11, 15. In the embodiment shown in the drawings, the cuts or knurlings 16 are provided in correspondence with the longitudinal folding lines 6, 7 which separate the panel 1 from the panel 2 and from the flap 5, but it is apparent that these cuts or knurlings could also extend from the two ends of the folding line 11 to two intermediate points on the folding line 15 shown in the drawings. In that case the two cuts or knurlings 16 would not be parallel but would diverge in the manner of a V and the second transverse folding line could extend along only a central part of the panel 1.

It is also important to note that preferably (as can be seen from the drawings), at least part of that free edge of the end panel 12 facing the closure panel 10 is more distant from the folding line 11 than the folding line 15. In this specific case this is achieved by shaping in the manner of a recess the upper free edge of the end panel 12 so that, when the box has been made up, the transverse folding line 15 of the panel 1 is only partly covered by the panel 12.

Figure 4:
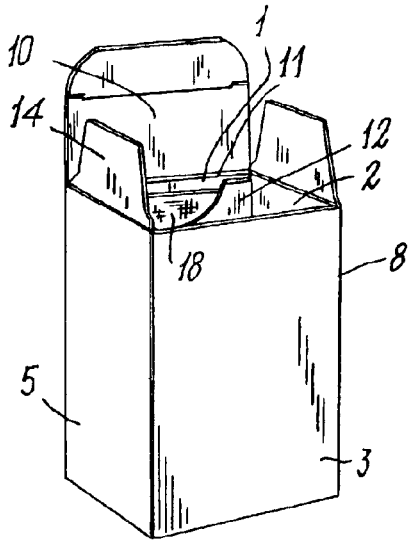
FIG. 4 is a side perspective view of the finished box with its upper closure panel open.

It will now be assumed that the box (housing the illustrative leaflet 18) is open as shown in FIG. 4.

Figure 5:
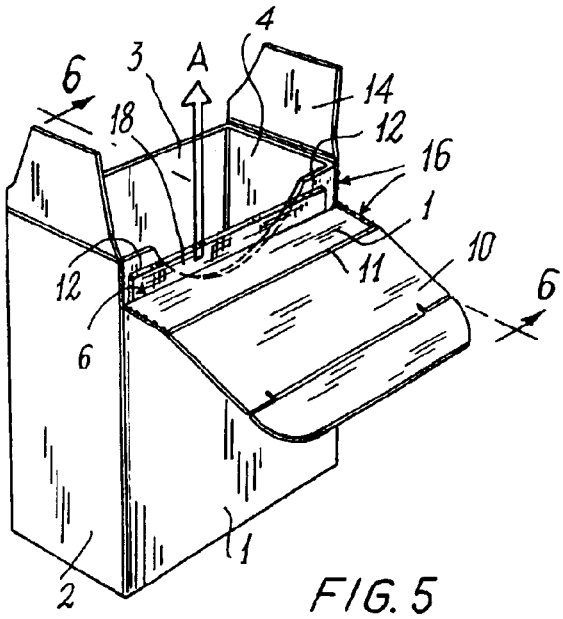
FIG. 5 is a perspective view of the box, seen from the opposite side to that of FIG. 4, under the conditions in which it appears with its closure panel open and folded up to enable the illustrative leaflet to be removed from the box.
Figure 6:
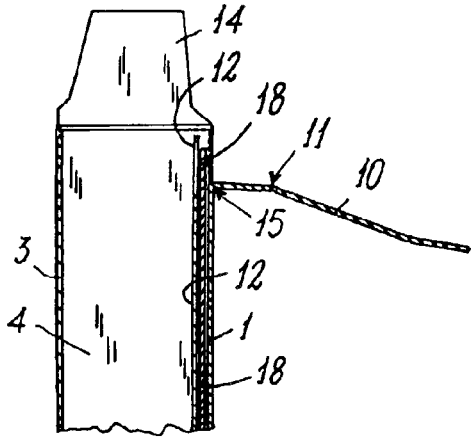
FIG. 6 is a cross-section through the box on the line 6—6 of FIG. 5.

When the leaflet 18 is to be withdrawn, that portion of the panel 1 between the folding lines 11, 15 is folded outwards (and with it the closure panel 10), as shown in FIGS. 5 and 6 after tearing the knurlings 16 (if these are provided instead of cuts already formed in the cardboard sheet).

Under these conditions at least a part of the upper portion of the leaflet 18 housed in the pocket of the box can be easily gripped by the two fingers of one hand and be extracted from the box in the direction of the arrow A of FIG. 5.

Likewise, with the box in the position shown in FIGS. 5 and 6, the leaflet can be repeatedly reinserted into or removed from the pocket of the box. It is very important to note that, starting from the folded position shown in FIGS. 5 and 6, the closure panel 10 can be easily and repeatedly returned into the position shown in FIG. 4 (by rotating it about the folding line 15) and then closed (as in the case of a box of known type) by rotating it about the folding line 11.

It is apparent that the upper (with respect to the drawings) edge of the panel 12 can be totally situated lower than the second transverse folding line 15 (in which case this upper edge can be rectilinear); alternatively the upper edge of the panel 12 can be simply inclined and intersect the second folding line 15, again facilitating the extraction and subsequent reinsertion of the leaflet 18 from and into the pocket of the box.

Finally it is apparent that both the upper and lower ends of the box can be shaped in the same manner as that described with reference to just the upper part of the box shown in the drawings.

What is claimed is:

1. A box formed from a single piece of punched and crease-lined cardboard, defining an internal pocket for containing an extractable leaflet, comprising:

at least first, second, third and fourth consecutive main panels and a flap which projects from the first main panel and is superposed on and glued to the fourth main panel in the finished box;

an end panel which projects from the fourth main panel and has a width equal to or less than that of the first main panel, the end panel forming with said first main panel a pocket for containing said extractable leaflet;

parallel longitudinal folding lines separating the main panels, the end panel and said flap from each other;

for at least one end of the box, a closure panel projecting from one end of the first main panel and separated there from by a first transverse folding line about which the closure panel can be rotated to open and respectively close said end of the box; and the main panels and also the end panel being folded about the respective longitudinal folding lines in such a manner that the end panel becomes superposed on the first main panel in the interior of the box to form said pocket therewith wherein in said first main panel there are provided both a second transverse folding line and a pair of cuts or tearable knurlings which extend between the ends of the first transverse folding line and the second transverse folding line to enable the closure panel and a portion of the first mail panel is bounded by the first and second transverse folding lines and by said pair of cuts or knurlings to be folded outward hence leaving uncovered and accessible from the outside of the box at least a portion of the extractable leaflet housed in the internal pocket of the box.

2. The box as claimed in claim 1, wherein at least a part of a free edge of the end panel facing said closure panel is more distant from the first transverse folding line than said second transverse folding line.

3. The box as claimed in claim 1, wherein said cuts or knurlings are provided in correspondence with the longitudinal folding lines which separate the first main panel from the flap and from the second main panel.

4. The box as claimed in claim 2, wherein said cuts or knurlings are provided in correspondence with the longitudinal folding lines which separate the first main panel from the flap end from the second main panel.

5. The box as claimed in claim 1, wherein a free end of the end panel facing the closure panel is profiled, presenting a recess which intersects said transverse second folding line.

6. The box as claimed in claim 2, wherein a free end of the end panel facing the closure panel is profiled, presenting a recess which intersects said transverse second folding line.

7. The box as claimed in claim 3, wherein a free end of the end panel facing the closure panel is profiled, presenting a recess which intersects said transverse second folding line.

8. The box as claimed in claim 4, wherein a free end of the end panel facing the closure panel is profiled, presenting a recess which intersects said transverse second folding line.

9. The box as claimed in claim 1, wherein a free end of the end of the panel facing the closure is profiled in the form of an arch.

10. The box as claimed in claim 1, wherein the pair of cuts or tearable knurlings diverge from each other in the form of a V.

11. The box as claimed in claim 10, wherein the second transverse folding line extends only along a central part of the first panel.

12. The box as claimed in claim 1, wherein at least a free edge of the end panel facing the closure panel is disposed totally below the second transverse folding line.

13. The box as claimed in claim 12, wherein the free edge is rectilinear.

14. A box as claimed in claim 1, wherein a free edge of the end panel facing the closure panel is inclined and intersects the second transverse folding line.

* * * * *